US006004116A

United States Patent [19]

Wang

[11] Patent Number: 6,004,116

[45] Date of Patent: Dec. 21, 1999

[54] AIR PUMP FOR AN INFLATABLE BODY HAVING A SAFETY HOLDING DEVICE

[75] Inventor: Kenneth Wang, Valencia, Calif.

[73] Assignee: Team Worldwide Corp., Taiwan

[21] Appl. No.: 08/971,190

[22] Filed: Nov. 17, 1997

[51] Int. Cl.[6] ..... F04B 43/00

[52] U.S. Cl. ..... 417/480; 417/472; 5/708

[58] Field of Search ..... 417/480, 472, 417/474, 478, 440; 5/708

[56] References Cited

U.S. PATENT DOCUMENTS

| | | | |
|---|---|---|---|
| 2,686,006 | 8/1954 | Hasselquist | 230/160 |
| 3,068,494 | 12/1962 | Pinkwater | 5/348 |
| 3,216,413 | 11/1965 | Arecheta Mota | 128/29 |
| 4,694,515 | 9/1987 | Rogers, Jr. | 5/13 |
| 4,782,542 | 11/1988 | Sato | 5/453 |
| 4,862,533 | 9/1989 | Adams, III | 5/413 |
| 4,930,174 | 6/1990 | Hunter | 5/454 |

*Primary Examiner*—Charles G. Freay
*Assistant Examiner*—Robert Z. Evora
*Attorney, Agent, or Firm*—Michael D. Bednarek; Crowell & Moring LLP

[57] ABSTRACT

An automatic air pump is built into an inflatable body. The automatic air pump includes a pump body, an air inlet and an air outlet. The pump body is automatically restorable and has an air chamber inside. The air outlet is provided on the pump body to introduce air into the inflatable body when the pump body is pressed. The air inlet is provided on the inflatable body to suck air outside the inflatable body into the pump body when the pump body is released.

7 Claims, 6 Drawing Sheets

AIR PUMP FOR AN INFLATABLE BODY HAVING A SAFETY HOLDING DEVICE

BACKGROUND OF THE INVENTION

1. Field of the Invention

The present invention relates in general to an automatic air pump that has merits of low cost and quick inflation.

2. Description of the Related Art

As shown in FIG. 1, an automatic air pump (8) of the prior art has a pump body (81) with a spring (82) received inside. The pump body (81) is made of flexible material, such as PVC, and can be flattened.

While operating the air pump (8), the user depresses it to discharge the air inside, through an air outlet (86). The pump body (81) is flattened and the spring (82) is compressed. Then, the user releases the air pump (8), restoring the pump body (81) automatically to its original shape under the action of the spring (82). Also, outside air is sucked into the air pump (8) through an air inlet (85). By repeating the above operations, the air pump (8) can continuously supply air.

Check valves (83) and (84) are necessarily provided in the air inlet (85) and air outlet (86) to control the direction of the airflow. It is understood that various kinds of check valves can be used.

However, a pump body (81) made of flexible material is easily punctured by the spring (82) which is generally made of steel. Furthermore, the air pump (8) cannot readily be packaged for sale and transport.

To solve the foregoing problem, U.S. Pat. No. 4,930,174 discloses an automatic air pump in which foam is received. The foam has many pores itself and is elastic. When the user depresses the air pump, both the foam and the pump body are flattened. The air contained in the pores of the foam is squeezed out, then into an air mattress (i.e. the air mattress is pumped). When the user releases the air pump, the foam regains its original shape due to its own elasticity and absorbs outside air through an air inlet.

In such a case, however, the foam in the air pump cannot contain too much air. Therefore, it takes many pumping operations to fill the air mattress with air. Another similar case is disclosed in Germany Patent DE 4034593 A1.

SUMMARY OF THE INVENTION

An object of the present invention is to provide an automatic air pump that solves the above-mentioned problem.

In accordance with the object of the present invention, an inflatable article with a built-in air pump is provided. The air pump comprises a pump body, an air chamber, an air outlet and an air inlet. The pump body includes a flexible material cover and foam material received in the flexible material cover, wherein at least one hole is provided on the flexible material cover to discharge a first portion of air that is contained in the foam material when the pump body is pressed. The air chamber is formed and surrounded by the pump body, wherein a second portion of air is contained in the air chamber. The air outlet is provided on the pump body to introduce the second portion of air, i.e., the air contained in the air chamber into the inflatable body when the pump body is pressed. The air inlet is provided on the inflatable body to suck a third portion of air outside the inflatable body into the air chamber when the pump body is released.

The inflation of this invention is quicker than that of the prior art, because the air pump of this invention that has an air chamber inside can provide more air in each operation. Furthermore, this invention saves the foam material due to the air chamber provided in the air pump.

Alternatively, an inflatable article is provided that comprises a hollow pump body, an inflatable body, an air outlet, an air inlet and a holding device. The hollow pump body is bellows-shaped and has a first portion of air inside. The pump body is built in the inflatable body. The air outlet is provided on the pump body to introduce the first portion of air, i.e., air contained in the hollow pump body, into the inflatable body when the pump body is pressed. The air inlet is provided on the inflatable body to suck a second air outside the inflatable body into the pump body when the pump body is released. The holding device is connected to the inflatable body so as to hold the inflatable body while the inflatable body is pumped to expand.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1:
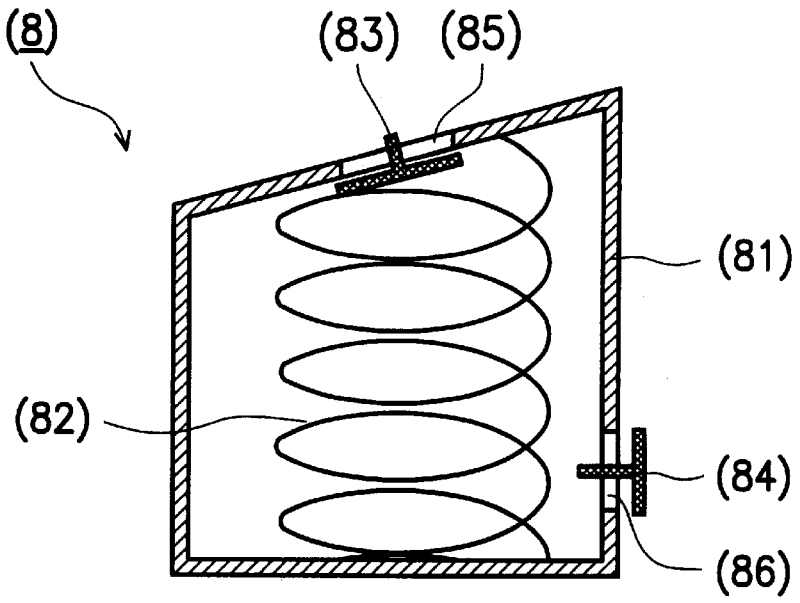
FIG. 1 (PRIOR ART)
FIG. 1 is a sectional schematic diagram of an automatic air pump according to the prior art.
Figure 2A:
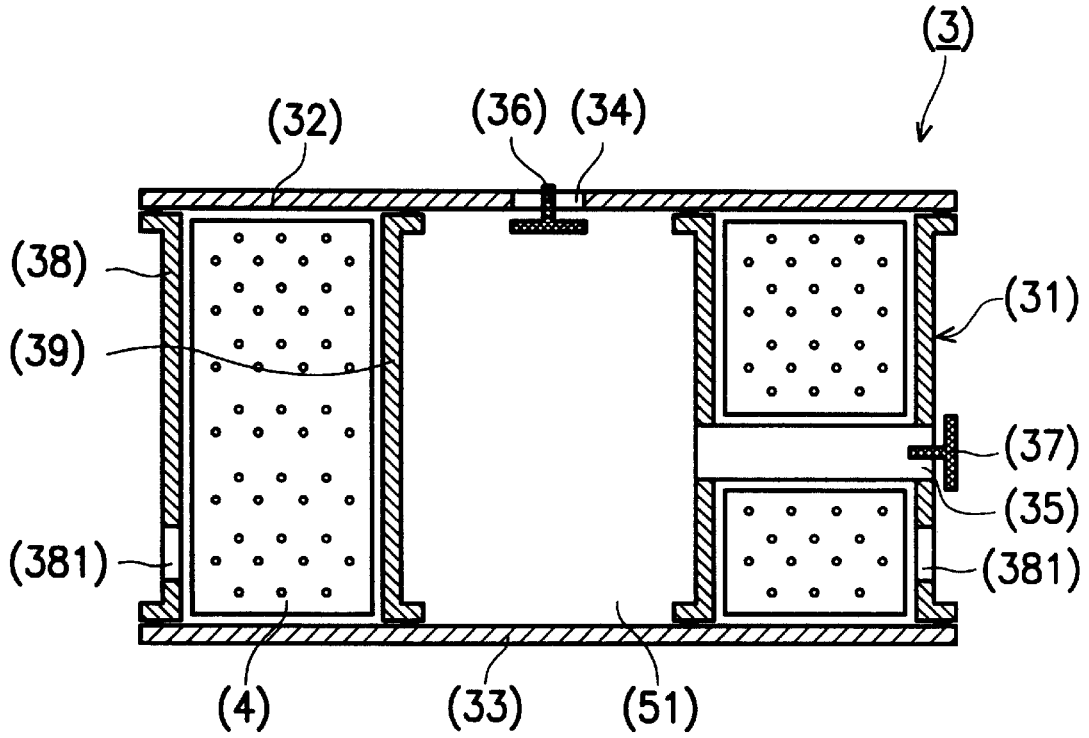
FIG. 2A is a sectional schematic diagram of an automatic air pump according to a first embodiment of this invention.

Now referring to FIG. 2A, an automatic air pump (3) of a first embodiment of this invention has a pump body (31), an upper end (32) and a lower end (33). An air inlet (34) and a check valve (36) are provided on the upper end (32), while an air outlet (35) and another check valve (37) are provided on the pump body (31). An air chamber (51) is formed and surrounded by the pump body (31). The pump body (31) is compressible, and has an outer wall (38), an inner wall (39) and a foam (4) disposed therebetween. A plurality of holes (381) are provided on the outer wall (38).

While operating the air pump (3), the user depresses the upper end (32). The pump body (31) is flattened to discharge air in the air chamber (51) through the air outlet (35). Also, air contained in the foam (4) is squeezed out, and discharged from the hole (381). Then, the user releases the upper end (32). The foam-contained pump body (11) can automatically expand by absorbing outside air (53) through the hole (381). Also, outside air is sucked into the air chamber (51) through the air inlet (34). By repeating such operations, the air pump (3) can continuously supply air. The two check valves (36) and (37) are provided to control the direction of airflow.

As described above, the foam (4) is disposed between the outer wall (38) and inner wall (39). The holes (381) are provided to discharge air contained in the foam (4) while the air pump (3) is pressed. On the other hand, the holes (381) allow the foam (4) to absorb outside air while the air pump (3) is released. It is therefore understood that, without the holes (381), the air pump (3) cannot function very well.

Figure 2B:
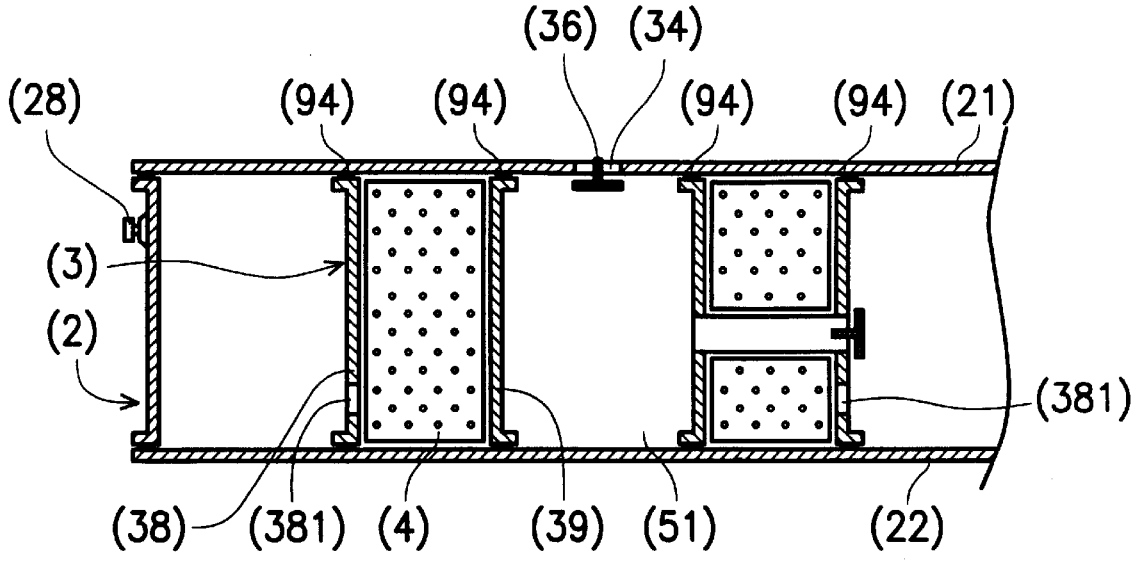
FIG. 2B shows a first application example of this invention.

FIG. 2B shows a first application example of this invention, wherein the air pump (3) of the first embodiment is built into an inflatable article (2). The inflatable article (2) can be, for instance, an inflatable mattress, an inflatable boat, an inflatable float, or any inflatable toy. The inflatable article (2) can be pumped by the air pump (3). An exhaust valve (28) is provided on the inflatable article (2) to deflate the inflatable article (2).

It is noted that the outer and inner walls (38), (39) of the pump body are connected to the upper and lower layers (21), (22) of the inflatable article (2). Reference numbers (94) indicate connected areas. Also, the air inlet (34) is provided on the upper layer (21) of the inflatable article (2). A plurality of holes (381) are provided on the outer wall (38) of the pump body. When the air pump (3) is flattened, air contained in the foam (4) is squeezed out, and discharged into the inflatable article (2) through the holes (381). When the air pump (3) is released, some air in the inflatable article (2) flows back through the holes (381) and is absorbed by the foam (4) so that the flattened foam (4) can expand.

The inflatable article (2) of this invention can be pumped more quickly than that of the prior art, because the air pump (3) of this invention that has an air chamber (51) inside can provide more air in each operation. Furthermore, this invention saves the foam material (4) due to the air chamber (51) provided in the air pump (3).

Figure 2C:
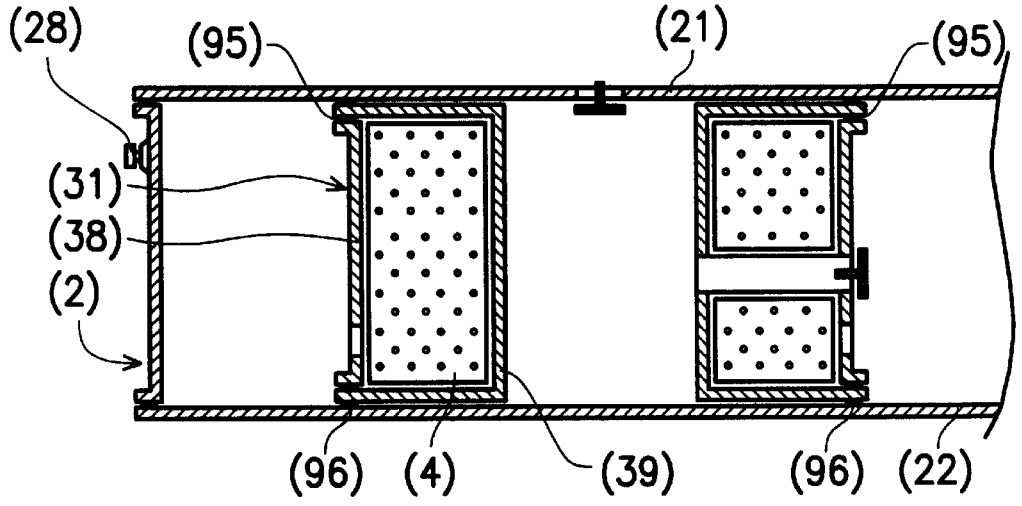
FIG. 2C shows a second application example of this invention.

FIG. 2C shows a second application example of this invention, in which the foam (4) is entirely housed by the outer and inner walls (38), (39). Reference numbers (95), (96) indicate connected areas. It is noted that the outer wall and inner wall are connected together, and the inner wall is connected to the upper and lower layers (21), (22) of the inflatable article (2).

Figure 2D:
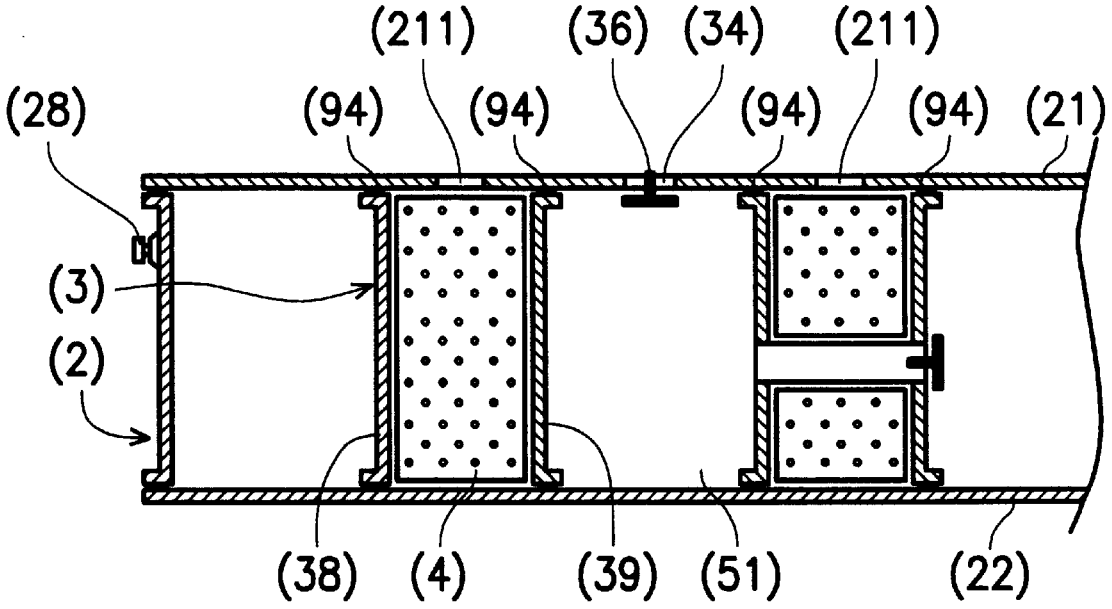
FIG. 2D shows a third application example of this invention.

FIG. 2D shows a third application example of this invention, in which a plurality of holes (211) are provided on the inflatable article (2). When the air pump (3) is flattened, air contained in the foam (4) is squeezed out, through the holes (211), to the atmosphere. When the air pump (3) is released, some air outside the inflatable article (2) flows back through the holes (381) and is absorbed by the foam (4) so that the flattened foam (4) can expand.

Figure 3:
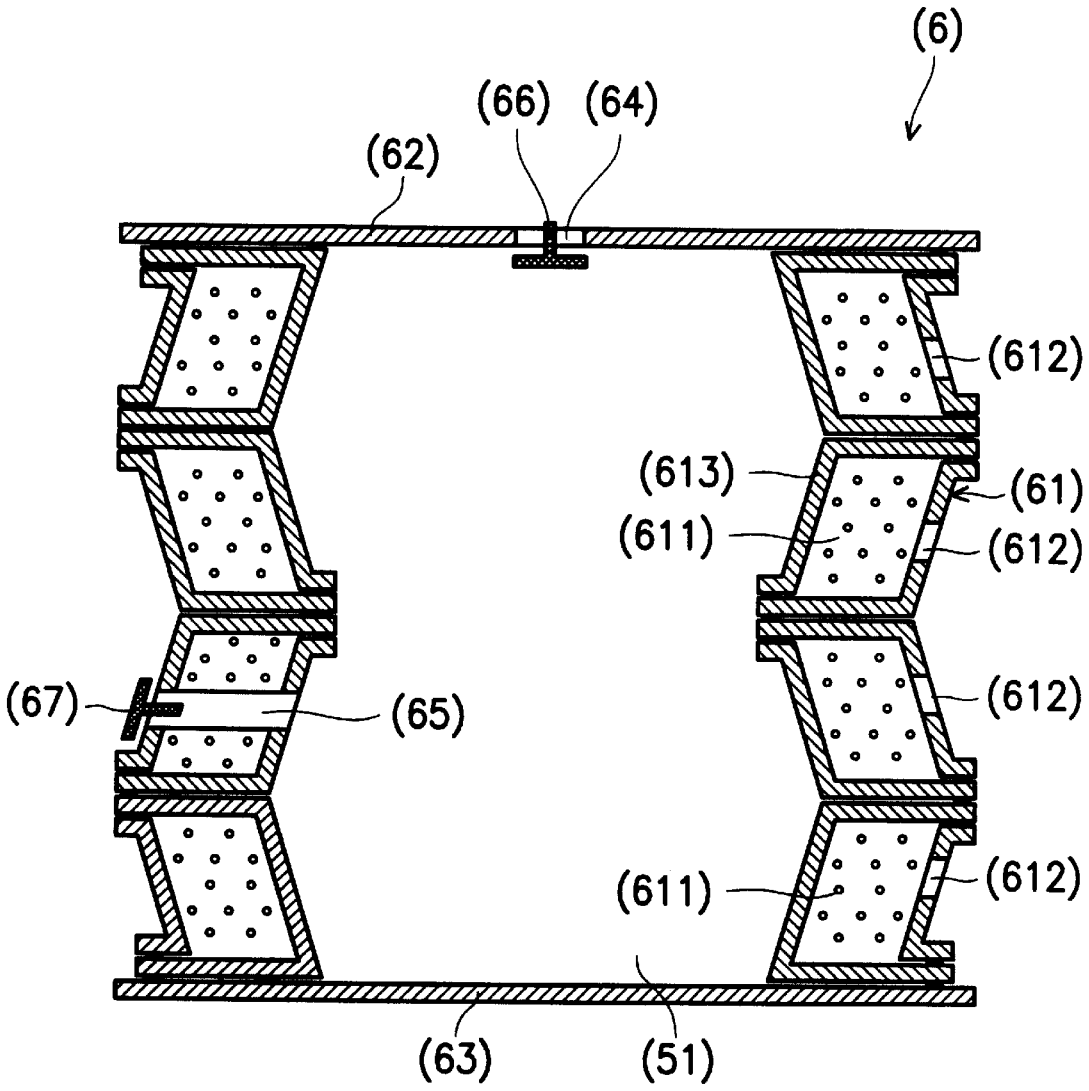
FIG. 3 is a sectional schematic diagram of an automatic air pump according to a second embodiment of this invention.

Referring to FIG. 3, an automatic air pump (6) according to a second embodiment of this invention comprises a pump body (61), an upper end (62) and a lower end (63). The pump body (61) is bellows-shaped, and consists of sections. Each section has a flexible material cover (613), a hole (612) provided thereon and foam material (611) received inside. An air inlet (64) and a check valve (66) are provided on the upper end (62), while an air outlet (65) and another check valve (67) are provided on the pump body (61). An air chamber (51) is formed and surrounded by the pump body (61).

While operating the air pump (6), the user depresses the end (62). The pump body (61) is flattened to discharge air in the air chamber (51) through the air outlet (65). At the same time, air contained in foam material (611) is squeezed out, and discharged from the holes (612). Then, the user releases the upper end (62). The foam-contained pump body (61) can automatically expand to suck outside air through the air inlet (64). The two check valves (66) and (67) are used to control the direction of air flow.

Figure 4A:
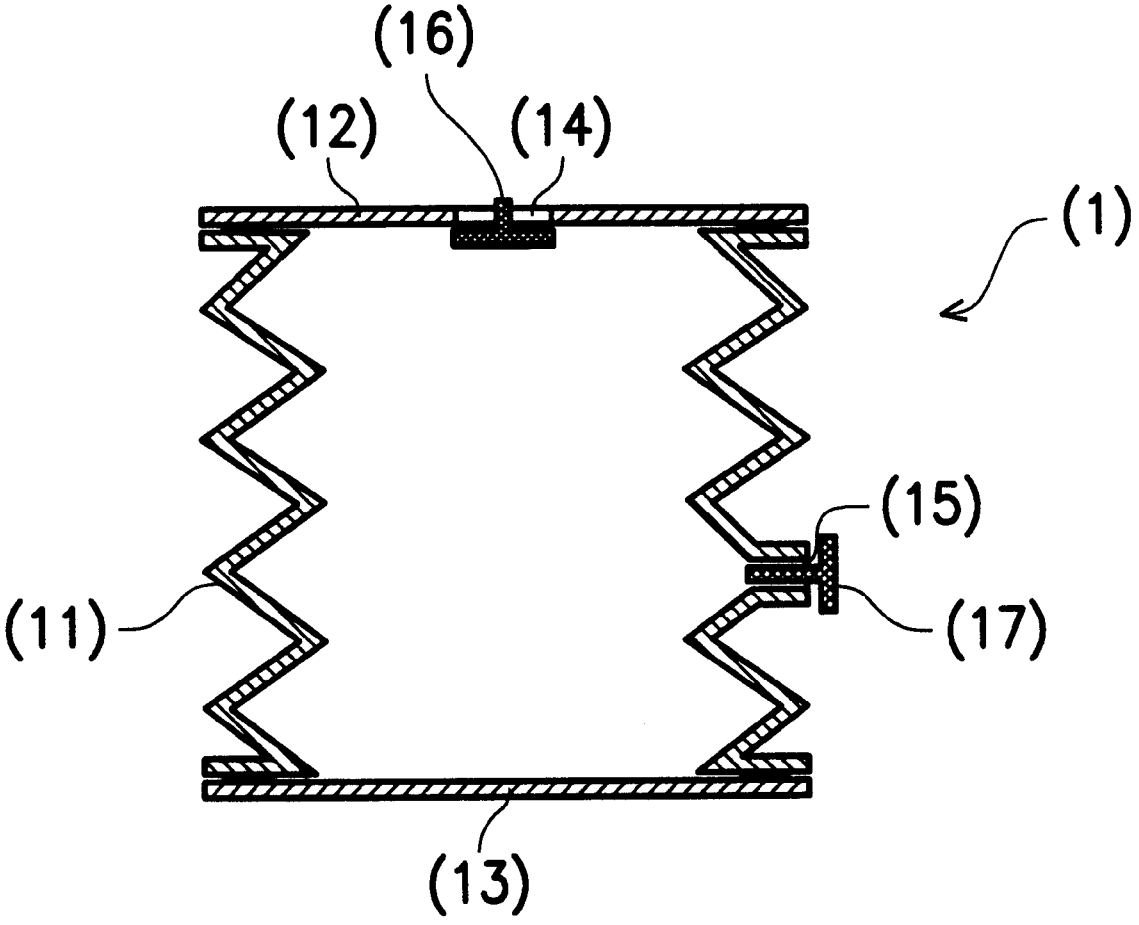
FIG. 4A is a sectional schematic diagram of an automatic air pump according to a third embodiment of this invention.

As shown in FIG. 4A, an automatic air pump (1) of a third embodiment of this invention has a pump body (11), an upper end (12) and a lower end (13). The pump body (11) is bellows-shaped and is compressible. An air inlet (14) is provided on the upper end (12), while an air outlet (15) is provided on the pump body (11).

While operating the air pump (1), the user depresses the upper end (12). The pump body (11) is flattened to discharge air inside, through the air outlet (15). Then, the user releases the upper end (12). The bellows-structured pump body (11) can automatically expand to suck outside air through the air inlet (14). By repeating such operations, the air pump (1) can continuously supply air. Check valves (16) and (17) are provided in the air inlet (14) and air outlet (15) to control the direction of air flow.

Figure 4B:
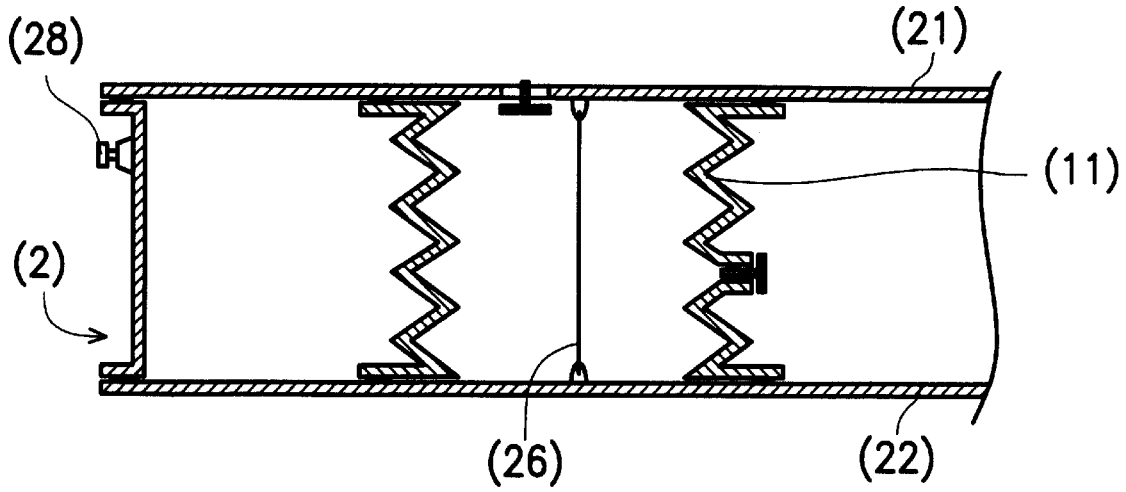
FIG. 4B shows a fourth application example of this invention.

FIG. 4B shows a fourth application example of this invention, in which the air pump (1) of the third embodiment is provided in an inflatable article (2). The inflatable article (2) can be pumped by the air pump (1). When being pumped to expand, the inflatable article may lose its designed shape. Furthermore, the pump body (11) is tightened when the inflatable article (2) is filled with air. This may cause an elastic failure to the pump body (11). Accordingly, a holding device is provided in the inflatable article (2) to prevent such problems. In the fourth application example, the holding device is a strap (26) provided in the pump body (11) to connect the upper layer (21) and the lower layer (22) of the inflatable article (2) . When the inflatable article (2) is filled with air, the strap (26) instead of the pump body (11) is tightened. By such an arrangement, the distance between the upper layer (21) and the lower layer (22) can be maintained. The inflatable article does not lose shape while being pumped. The elastic failure of the pump body can be prevented.

Figure 4C:
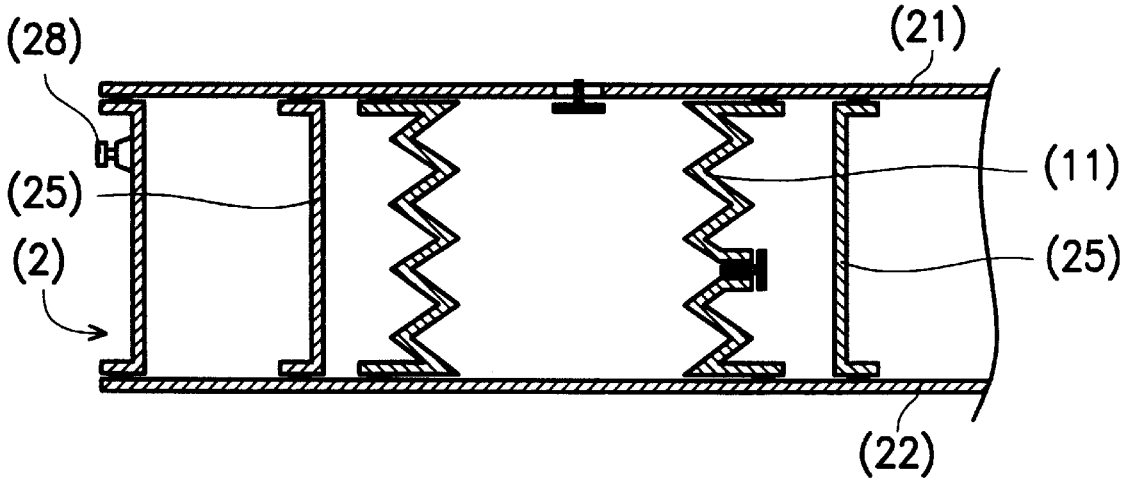
FIG. 4C shows a fifth application example of this invention.

FIG. 4C shows a fifth application example of this invention, in which the holding device is a loop band (25) provided outside the pump body (11) to connect the upper layer (21) and the lower layer (22) of the inflatable article (2). When the inflatable article (2) is filled with air, the loop band (25) instead of the pump body (11) is tightened.

Although this invention has been described in its preferred forms and various examples with a certain degree of particularity, it is understood that the present disclosure of the preferred forms and the various examples can be changed in the details of construction. Accordingly, the scope of the invention should be determined by the appended claims and not by the specific examples given herein.

What is claimed is:

1. An inflatable article, comprising:

a pump body including a flexible material cover, wherein at least one hole is provided on the flexible material cover to discharge a first portion of air, which is contained in the foam material, when the pump body is pressed;

an air chamber formed and surrounded by the pump body; wherein a second portion of air is contained in the air chamber;

an inflatable body into which the pump body is built;

an air outlet provided on the pump body to introduce the second portion of air into the inflatable body when the pump body is pressed; and an air inlet provided on the inflatable body to suck a third portion of air from outside the inflatable body into the air chamber when the pump body is released.

2. An inflatable article as claimed in claim 1, further comprising an exhaust valve provided on the inflatable body to deflate the inflatable body.

3. An inflatable article as claimed in claim 1, wherein the pump body is bellows-shaped.

4. An inflatable article, comprising:

a hollow pump body being bellows-shaped and having a first Portion of air inside;

an inflatable body into which the pump body is built;

an air outlet provided on the pump body to introduce the first portion of air into the inflatable body when the pump body is pressed;

an air inlet provided on the inflatable body to suck a second portion of air from outside the inflatable body into the pump body when the pump body is released; and a holding device connected to the inflatable body to hold the inflatable body while the inflatable body is pumped to expand.

5. An inflatable article as claimed in claim 4, wherein the holding device is provided in the pump body.

6. An inflatable article as claimed in claim 4, wherein the holding device is provided in the inflatable body, but outside the pump body.

7. An inflatable article as claimed in claim 4, further comprising an exhaust valve provided on the inflatable body to deflate the inflatable body.

* * * * *